US009574340B1

(12) United States Patent
Scoggins

(10) Patent No.: US 9,574,340 B1
(45) Date of Patent: Feb. 21, 2017

(54) PROTECTIVE ENCLOSURE FOR CONCRETE ANCHOR BOLTS

(71) Applicant: Marrk Scoggins, Euless, TX (US)

(72) Inventor: Marrk Scoggins, Euless, TX (US)

( * ) Notice: Subject to any disclaimer, the term of this patent is extended or adjusted under 35 U.S.C. 154(b) by 0 days.

(21) Appl. No.: 14/810,651

(22) Filed: Jul. 28, 2015

Related U.S. Application Data

(60) Provisional application No. 62/031,510, filed on Jul. 31, 2014.

(51) Int. Cl.

| | |
|---|---|
| ***E02D 27/42*** | (2006.01) |
| ***E02D 5/74*** | (2006.01) |
| ***E04G 13/00*** | (2006.01) |
| ***E04B 1/21*** | (2006.01) |
| *E04G 21/14* | (2006.01) |
| *B28B 1/44* | (2006.01) |
| *E04B 1/64* | (2006.01) |

(52) U.S. Cl.
CPC ..... *E04B 1/21* (2013.01); *E02D 27/42* (2013.01); *B28B 1/445* (2013.01); *E02D 5/74* (2013.01); *E04B 1/642* (2013.01); *E04G 13/00* (2013.01); *E04G 21/142* (2013.01)

(58) Field of Classification Search
CPC ..... E04G 13/00; E04G 21/142; E04G 21/24; E04G 21/185; E04G 21/3252; B28B 1/445; E01C 23/021; E01C 23/026; E04B 1/642; E04B 5/326; E02D 27/42; E02D 5/74; E02D 2250/0023
USPC ..... 249/118, 117, 109, 34, 33; 52/295, 294, 52/297, 298, 300, DIG. 12, 741.3, 741.4
See application file for complete search history.

(56) References Cited

U.S. PATENT DOCUMENTS

| | | | | | |
|---|---|---|---|---|---|
| 2,166,632 | A * | 7/1939 | Hardesty | E02D 29/12 | 405/133 |
| 2,971,295 | A * | 2/1961 | Reynolds | E02D 27/01 | 248/679 |
| 3,302,509 | A * | 2/1967 | Modrey | E21D 21/008 | 285/8 |
| 3,586,395 | A * | 6/1971 | Weaver | B23Q 1/0063 | 384/39 |
| 4,001,990 | A * | 1/1977 | Chase | E04H 9/02 | 52/167.4 |
| 4,642,964 | A * | 2/1987 | Kellison | E04B 1/4121 | 52/699 |
| 5,169,544 | A * | 12/1992 | Stanfill | E04G 15/02 | 249/22 |
| 5,332,191 | A * | 7/1994 | Nolan | B28B 7/0073 | 249/1 |
| 5,819,487 | A * | 10/1998 | Bull | E02D 27/42 | 52/295 |

(Continued)

*Primary Examiner* — Phi A
(74) *Attorney, Agent, or Firm* — Kenneth L Tolar

(57) ABSTRACT

A protective cover for concrete anchor bolts includes a hollow, box-shaped housing having a bottom wall with a plurality of elongated, narrow slots thereon that are positioned and spaced to receive various patterns of cast-in anchor bolts. A top wall includes a plurality of wide openings to provide to access to the anchor bolts. Accordingly, a worker superimposes the housing onto a set of concrete anchor bolts with each received within one of the narrow slots on the bottom wall. Using the wider openings on the top wall, the worker tightens nuts onto the anchor bolts to secure the housing to the underlying concrete prior to pouring a surrounding floor. Once the surrounding concrete floor has dried, the nuts are removed and the enclosure is lifted from the formed indention.

5 Claims, 2 Drawing Sheets

(56) References Cited

U.S. PATENT DOCUMENTS

| | | | | |
|---|---|---|---|---|
| 7,435,084 | B2 * | 10/2008 | Liu | A61C 9/002 433/34 |
| 8,739,494 | B2 * | 6/2014 | Francavilla | E04C 2/06 52/253 |
| 8,898,993 | B2 * | 12/2014 | Rodgers | E04B 1/003 52/289 |
| 9,127,415 | B1 * | 9/2015 | Blackwell | E04G 15/04 |
| 9,194,125 | B1 * | 11/2015 | Romanenko | E04C 1/40 |
| 2004/0211148 | A1 * | 10/2004 | Foust | E04C 3/32 52/831 |
| 2005/0144866 | A1 * | 7/2005 | Chappell | B65D 90/24 52/294 |
| 2007/0017176 | A1 * | 1/2007 | Gray | E04B 2/30 52/605 |
| 2007/0186502 | A1 * | 8/2007 | Marsh | E04B 2/16 52/604 |
| 2010/0111602 | A1 * | 5/2010 | Yodock, III | E01F 15/083 404/6 |
| 2013/0036679 | A1 * | 2/2013 | Nyce | E04H 12/2261 52/105 |

* cited by examiner

PROTECTIVE ENCLOSURE FOR CONCRETE ANCHOR BOLTS

CROSS REFERENCE TO RELATED APPLICATIONS

This application is entitled to the benefit of provisional patent application No. 62/031,510 filed on Jul. 31, 2014, the specification of which is incorporated herein by reference.

BACKGROUND OF THE INVENTION

The present invention relates to a cover that protects precast anchor bolts while a concrete floor is being poured.

DESCRIPTION OF THE PRIOR ART

During construction, cast-in anchor bolts are installed to secure support columns to a concrete foundation. Typically, the bolts are uprightly inserted into a lower layer of wet concrete with their threaded ends exposed. Once the wet concrete hardens, the anchor bolts are permanently embedded in the foundation. Thereafter, forms are erected around the bolts to create an indention for receiving the column when a concrete floor is poured onto the foundation.

Until the floor is poured, the upwardly extending bolts pose a tripping hazard and can damage equipment tires. Furthermore, if the protruding forms are damaged by a work vehicle, they must be replaced, which is burdensome and time consuming. After the floor has been poured, the created indentions can cause a work vehicle to overturn and eject a load or an operator, resulting in serious injury or death. Finally, because the wooden forms adhere to the dried concrete, they often chip or damage the floor during removal.

Accordingly, there is currently a need for device that protects cast-in anchor bolts and surrounding concrete while a concrete floor is being poured. The present invention addresses this need by providing a hollow enclosure that is superimposed onto the bolts prior to a concrete floor being poured to form a protective barrier.

SUMMARY OF THE INVENTION

The present invention relates to a protective cover for concrete anchor bolts comprising a hollow, box-shaped housing having a bottom wall with a plurality of elongated, narrow slots thereon that are positioned and spaced to receive various patterns of cast-in anchor bolts. A top wall includes a plurality of wide openings that are aligned with the slots to provide to access to the anchor bolts. Accordingly, a worker superimposes the housing onto a set of precast concrete anchor bolts with each bolt received within one of the narrow slots on the bottom wall. Using the wider openings on the top wall, the worker tightens nuts onto the anchor bolts to secure the housing to the concrete foundation prior to pouring a floor. Once the surrounding concrete floor has been poured and dried, the nuts are removed and the enclosure is lifted from the formed indention.

It is therefore an object of the present invention to provide a protective enclosure for concrete anchor bolts.

It is another object of the present invention to provide a protective enclosure for concrete anchor bolts that is easily separable from surrounding concrete.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
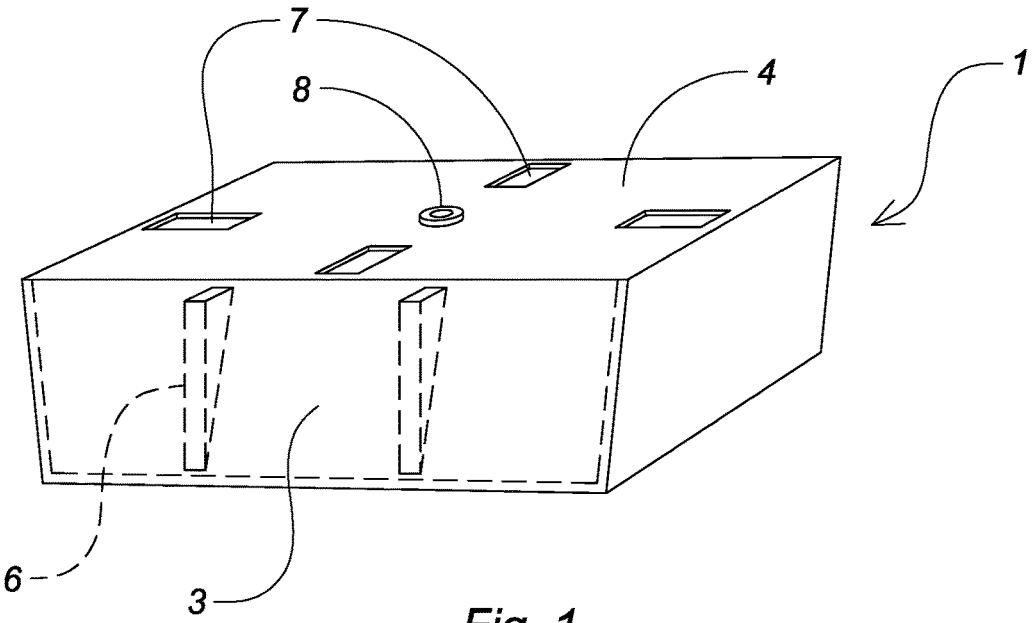
FIG. 1 is a perspective view of the enclosure according to present invention.
Figure 2:
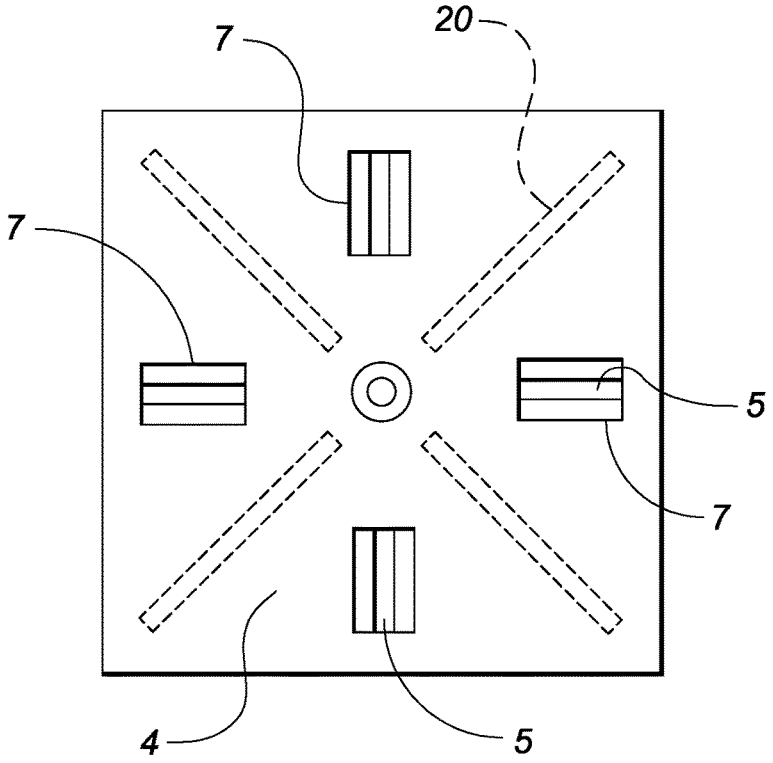
FIG. 2 is a top view of the enclosure, depicting the wide openings superimposed on the narrow slots.
Figure 3:
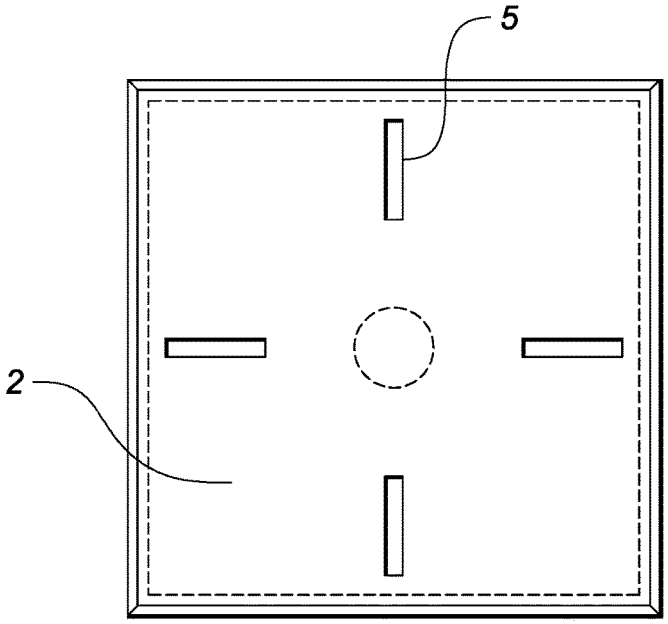
FIG. 3 is a bottom view of the enclosure.
Figure 4:
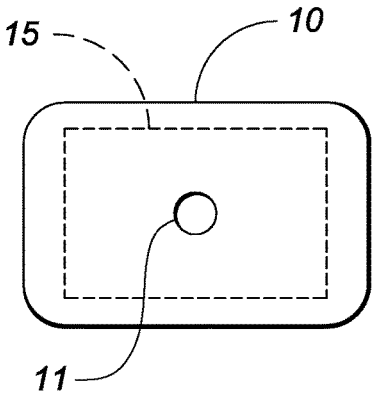
FIG. 4 is a top view of an exemplary plug for the wider opening.
Figure 5:
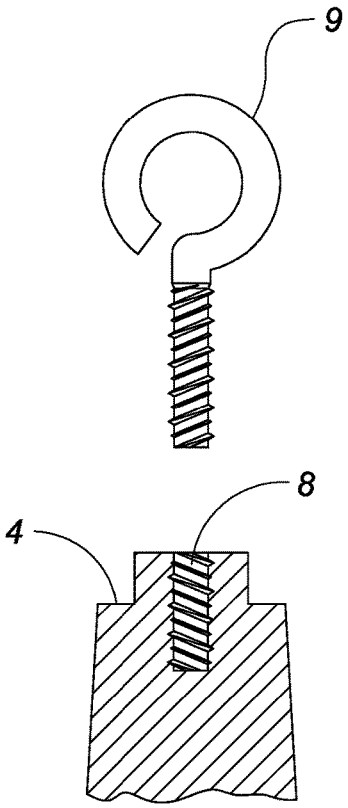
FIG. 5 is an isolated view of the bore and threaded eye hook for lifting the enclosure from dried concrete.

The present invention relates to a protective cover for concrete anchor bolts comprising a hollow, box-shaped housing 1 having a bottom wall 2, one or more sidewalls 3 and a top wall 4. The housing has a wedge-shaped configuration with sidewalls that angle inwardly from a top edge toward a bottom edge to facilitate removal from poured, dried concrete. The bottom wall includes a plurality of elongated, narrow slots 5 that are positioned, oriented and spaced to receive various patterns of precast anchor bolts. The drawings depict slots that radially extend from a central position on the bottom wall, though the orientation can vary to accommodate any pattern and spacing of anchor bolts.

The sidewalls each include triangular reinforcing ribs 6 that enhance the structural integrity of the housing. The top wall includes a plurality of wide openings 7, each of which is aligned with one of the narrow slots on the bottom wall, to allow a tool or a worker's hand to access the enclosed anchor bolts. Mating plugs 10 may be inserted into the wider openings 7 to prevent concrete intrusion when a concrete floor is being poured around the enclosure. Each plug includes a central finger aperture 11 that allows the worker to easily remove the plugs once the floor has dried. On a lower surface of each plug is an insert 15 that is dimensioned and configured to firmly fit within the opening 7 to prevent inadvertent removal.

Centrally positioned on the top wall of the housing is a threaded bore 8 for receiving a threaded eye-hook 9 that can be grasped by a lifting tool to remove the enclosure from surrounding, dried concrete. The top wall includes diagonal struts 20 on a lower surface to prevent bending or deforming when subjected to a substantial load.

Accordingly, to use the enclosure, a worker superimposes the housing onto a set of concrete anchor bolts with each received within one of the narrow slots on the bottom wall. Shims can be positioned beneath the housing to level the enclosure, if necessary. A worker then inserts a tool or hand into the wider openings on the top wall to tighten nuts onto the anchor bolts and secure the housing to the concrete foundation. The plugs 10 are inserted into the wider openings and the concrete floor is poured around the enclosure to form the column indention. Then, the nuts are removed, a lifting tool is secured to the eye hook and the enclosure is raised from the indention.

The above-described device is not limited to the exact details of construction and enumeration of parts provided herein. Furthermore, the size, shape and materials of construction of the various components can be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. In combination with a poured concrete foundation having precast anchor bolts therein, an enclosure for protecting said anchor bolts while a concrete floor is being poured onto said foundation, said enclosure comprising:

a hollow housing having a bottom wall, a plurality of sidewalls and a top wall;

a plurality of elongated, narrow slots on said bottom wall, said slots receiving said anchor bolts;

a plurality of openings on said top wall that are each aligned with a designated slot on said bottom wall, said openings dimensioned to receive a hand to allow a worker to fasten a nut to each of said anchor bolts to secure said housing to said foundation, and to subsequently remove said nut to remove said housing from the foundation, whereby a concrete floor is poured around said housing to form a column indention while said enclosure encapsulates said bolts until said floor has dried and a column can be installed within said indention;

a hook on the top wall;

a lifting tool secured to said hook to remove said housing from said indention.

2. The enclosure according to claim 1 wherein said sidewall includes reinforcing ribs that enhance the structural integrity of said housing.

3. The enclosure according to claim 1 wherein said top wall is structurally reinforced with struts on a lower surface that allow said top wall to withstand a load without bending or deforming.

4. The enclosure according to claim 1 further comprising a plug received within each of said openings to prevent concrete intrusion into said housing while the concrete floor is being poured.

5. The enclosure according to claim 1 wherein said sidewalls angle inwardly from a top edge toward a bottom edge so that said housing has a wedge-shaped configuration to facilitate removal from said indention.

* * * * *